US008118714B2

(12) United States Patent
Ramsay-Matthews

(10) Patent No.: US 8,118,714 B2
(45) Date of Patent: Feb. 21, 2012

(54) PORTABLE BOXING AND MARTIAL ARTS TRAINING APPARATUS

(76) Inventor: Gerard Ramsay-Matthews, Trott Park (AU)

( * ) Notice: Subject to any disclaimer, the term of this patent is extended or adjusted under 35 U.S.C. 154(b) by 0 days.

(21) Appl. No.: 12/667,258

(22) PCT Filed: Jun. 10, 2008

(86) PCT No.: PCT/AU2008/000827

§ 371 (c)(1),
(2), (4) Date: Jun. 3, 2010

(87) PCT Pub. No.: WO2009/003214

PCT Pub. Date: Jan. 8, 2009

(65) Prior Publication Data

US 2010/0248908 A1 Sep. 30, 2010

(30) Foreign Application Priority Data

Jul. 4, 2007 (AU) ..... 2007903622

(51) Int. Cl.
*A63B 21/00* (2006.01)

(52) U.S. Cl. ..... 482/45; 482/46

(58) Field of Classification Search ..... 482/83–90
See application file for complete search history.

(56) References Cited

U.S. PATENT DOCUMENTS

| | | | | | |
|---|---|---|---|---|---|
| 426,944 | A | * | 4/1890 | Lovatt | 482/89 |
| 708,573 | A | * | 9/1902 | Miles | 482/89 |
| 843,389 | A | * | 2/1907 | Brown | 482/90 |
| 1,267,678 | A | * | 5/1918 | McArdle | 482/89 |
| 1,694,044 | A | * | 12/1928 | Thompson | 482/87 |
| 2,249,309 | A | * | 7/1941 | Benko | 73/379.05 |
| 4,077,624 | A | * | 3/1978 | Feaser | 482/87 |
| 4,749,185 | A | * | 6/1988 | Spears | 482/89 |

* cited by examiner

*Primary Examiner* — Jerome w Donnelly
(74) *Attorney, Agent, or Firm* — Weiner & Burt, P.C.; Irving M. Weiner; Pamela S. Burt

(57) ABSTRACT

The present invention relates to a hand-eye coordination training apparatus designed for all sports enthusiasts and martial artists seeking hand speed timing and accuracy. The apparatus offers unpredictable vertical and horizontal target movement, as well as instant adjustability to change the tension and height of the target. This allows the target to travel at varied heights, speeds and distances. The apparatus is effective in isolating the skill of hand eye coordination because it provides minimal resistance. The apparatus is completely portable and can be assembled in any environment in a matter of seconds.

18 Claims, 17 Drawing Sheets

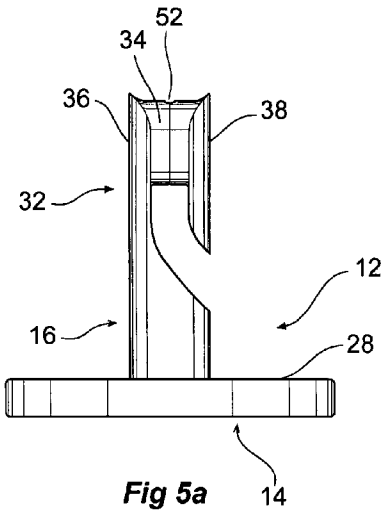
Fig 5a
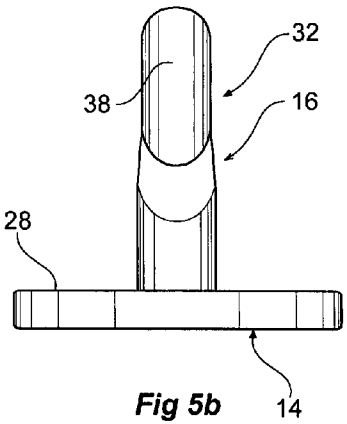
Fig 5b
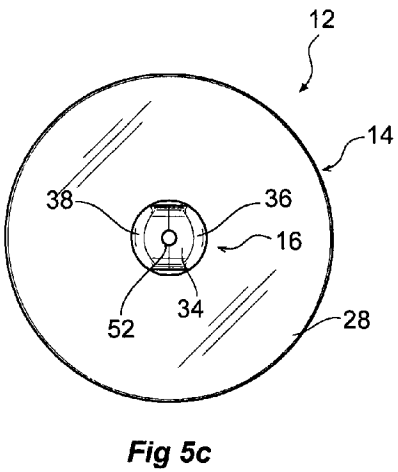
Fig 5c
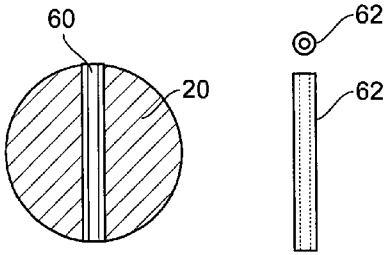
Fig 7a
Fig 7b
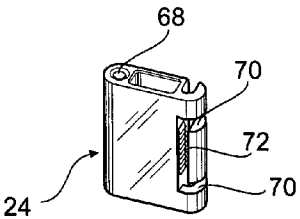
Fig 8
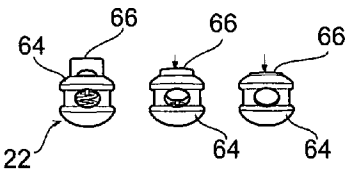
Fig 6a
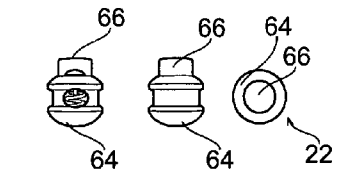
Fig 6b

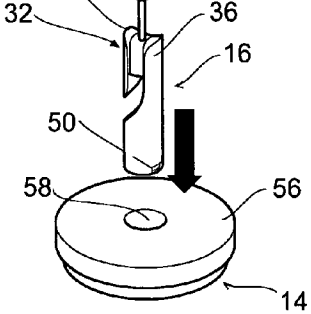
Fig 10b
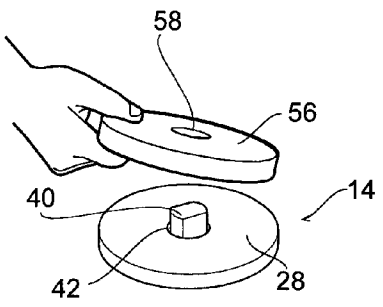
Fig 10a
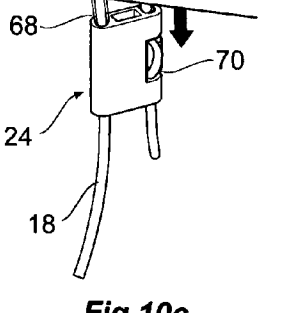
Fig 10c
Fig 10d
Fig 10e
Fig 11

PORTABLE BOXING AND MARTIAL ARTS TRAINING APPARATUS

The present invention relates to a portable training apparatus for improving the skills of boxers, martial artists and the like.

BACKGROUND OF THE INVENTION

Over the centuries, boxers and martial artists have developed training apparatus to improve on various skill sets required to execute their fighting art form. These apparatus have ranged from simple devices such as skipping ropes which improve foot speed, to more complex machines such as the various resistance training machines currently available. All fighting art forms demand a high level of athleticism, speed, timing, balance, and strength. These skills are the fundamental driving force of any modern athlete, and effective pre-event training is the key to success in an athlete's sport of choice.

Modern athletes have learnt that isolating particular skill sets vastly improves their ability to play their sport. For example, a boxer may break up his or her training sessions to incorporate:

- skipping, for foot speed and coordination;
- weights, to improve strength;
- punching of a heavy bag, to improve striking and strength simultaneously;
- treadmill, to improve cardiovascular;
- speed ball, to improve hand-eye coordination, speed, and timing;
- medicine ball, to improve plyometric motion; and
- sparring which consolidates the abovementioned skills.

Athletes and coaches are always looking to different training apparatus and techniques to obtain further advantage over their competitors. Many of these however have a number of shortcomings. For example, prior art training apparatus:

- tend to be predictable in their movement and do not have the ability for the user to increase randomness and unpredictably;
- are typically heavy duty and do not promote precision hand-eye coordination, explosive movements without heavy resistance, and consistent motion and accuracy;
- are not truly portable in that they are designed and constructed to be fixed in one position and subsequently used in that location, for example, in a fixed gym location;
- have strike balls which only move within a restricted distance from a central vertical axis, and have no or limited vertical movement;
- typically involve the use of inflatable strike balls which deflate over time and require replacement, or the use of a pump for re-inflation;
- do not easily provide for the possibility of multiple targets, nor do they allow for easy adjustment of target's position to suit a particular exercise;
- are required to be used indoors to prevent wear of ball leather and rusting of metal buckles and clips, and do not allow a user to train in environments of their own choosing;
- are typically large, bulky and not easily packaged for retail purposes; and
- are generally quite complex, cumbersome in nature, and expensive.

It is therefore an object of the present invention to overcome at least some of the aforementioned problems or to provide the public with a useful alternative.

SUMMARY OF THE INVENTION

Therefore in one form of the invention there is proposed a portable exercise training apparatus, characterised by:

an anchor;

a resilient cord including a first end and a second end, said first end adapted to be secured to said anchor and said second end adapted to be secured to a supporting structure located a spaced apart distance from said anchor, whereby said cord extends at a predetermined tension between the anchor and the supporting structure;

at least one lightweight strike target configured to be moveable along said cord, and lockable at predetermined positions; and a cord tensioning means associated with said anchor, said cord tensioning means configured to provide for incremental adjustment of the cord tension.

Preferably said cord tensioning means is in the form of a spool about which said resilient cord is windable, whereby each winding of the cord represents tensioning of the cord by one increment from said predetermined tension.

In preference said cord is of a resilience to allow for winding of said cord approximately eight times about the spool, representing eight different increments of tension.

In a first embodiment of the invention said anchor includes a base plate adapted to be placed on a ground surface, and an upright portion positioned at the centre of the base plate.

Preferably said apparatus further includes at least one weighted disk adapted to rest on said base plate and thereby prevent the anchor from moving during use, said weighted disk including a central aperture adapted to accommodate the upright portion of the anchor.

In preference said apparatus includes two 1.25 kilogram weighted disks.

Preferably said spool is disposed in said anchor upright portion.

In preference said base plate is circular, and said upright portion is substantially cylindrical.

Preferably said base plate and said upright portion are manufactured separately, and configured so that said upright portion and base plate engage by way of a snap fit connection.

In a second embodiment of the invention the anchor is constructed of material of sufficient weight to ensure that it does not move during use.

Preferably said spool is disposed in said weighted structure.

Preferably said structure is substantially hemispherical in shape with a flat surface for placement on the ground, the structure comprising two spaced apart halves connected by said spool.

In preference tensioning of the cord is achieved by rotation of the structure about a horizontal axis.

Preferably said strike target is lockable along the cord using cord locks which include locking members that are moveable between a first position in which said cord is engaged by the lock, and a second position in which said cord is disengaged, said locking member being biased in said first position.

In preference two chord locks are spaced apart on said cord to enable free vertical movement of said strike target between the spaced apart cord locks.

Preferably said apparatus includes a plurality of strike targets locked at predetermined heights along said cord so that when one of said strike targets is struck, the remaining strike targets cause the struck target to move in an even further unpredictable manner.

Preferably said apparatus includes at least one group of two or more adjacent strike targets positioned along the cord.

In preference said strike target is in the form of a non-inflatable, soft, rubber ball.

Advantageously said ball is spherical in shape and approximately 5.5 centimeters in diameter.

In preference said apparatus includes a plurality of differently shaped strike targets, including balls having outwardly extending protrusions, to ensure still further unpredictability.

Preferably said base is of a size that may be transported by hand by a user.

BRIEF DESCRIPTION OF THE DRAWINGS

The accompanying drawings, which are incorporated in and constitute a part of this specification, illustrate several implementations of the invention and, together with the description, serve to explain the advantages and principles of the invention. In the drawings.

FIGS. 5*a*-5*c* illustrate a side, front and top view of the floor anchor;

FIG. 6*a* illustrates progressively how a cord lock forming part of the apparatus of FIG. 1 is operated to change from a locked state to an unlocked state;

FIG. 6*b* illustrates a front, side and top view of the cord lock of FIG. 4*a*.

FIG. 7*a* illustrates a side view of a striking ball forming part of the apparatus of FIG. 1;

FIG. 7*b* illustrates a side and top view of a cylindrical insert for the ball of FIG. 5*a;*

FIG. 8 illustrates a cord height adjustment clip forming part of the apparatus of FIG. 1;

FIGS. 10*a*-10*e* illustrate sequentially the steps involved in assembling and adjusting the training apparatus of the present invention;

FIG. 11 illustrates the distances the ball is able to travel from the vertical axis when the cord is set at different tensions;

DESCRIPTION OF THE PREFERRED EMBODIMENTS

The following detailed description of the invention refers to the accompanying drawings. Although the description includes exemplary embodiments, other embodiments are possible, and changes may be made to the embodiments described without departing from the spirit and scope of the invention. Wherever possible, the same reference numbers will be used throughout the drawings and the following description to refer to the same and like parts.

The present invention relates to an apparatus 10 for use by boxers, martial artists and other athletes. The apparatus 10 is a portable, offensive and defensive training tool which provides users with the ability to adapt the apparatus to their specific needs and to concentrate specifically on improving speed, timing and accuracy training with minimal resistance. The apparatus 10 is extremely versatile in that it is lightweight, may be transported with ease, and may be assembled and disassembled in a matter of seconds.

Figure 1:
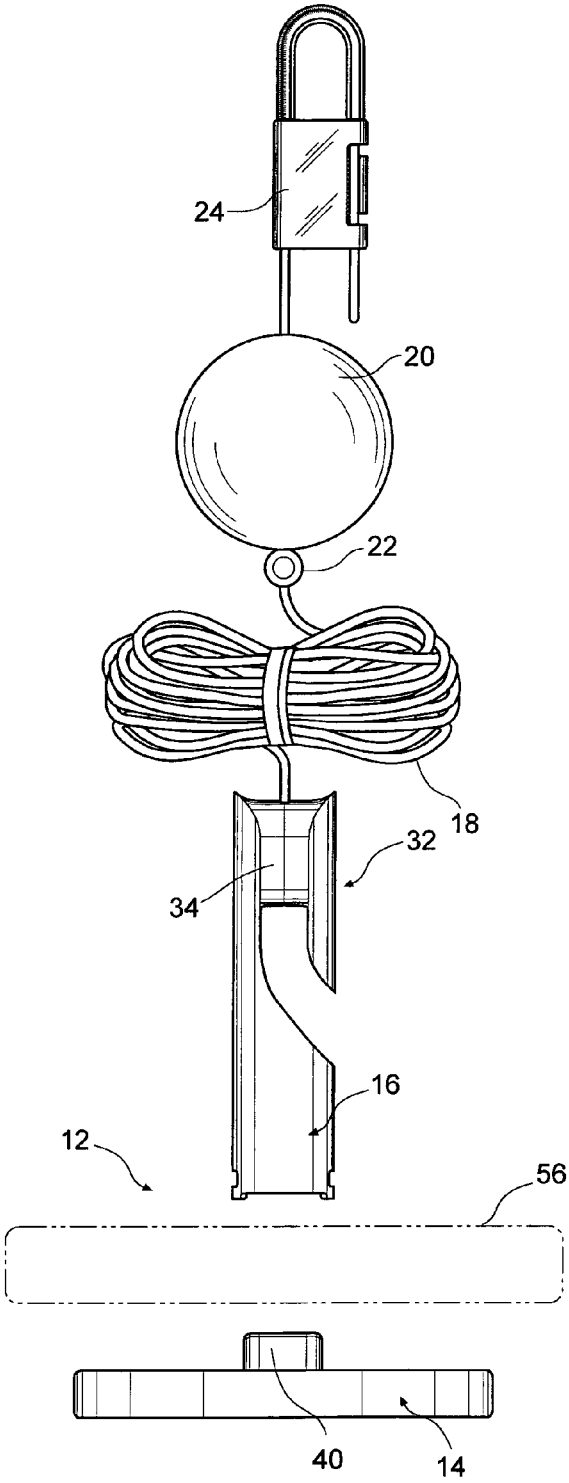
FIG. 1 illustrates in a front, partially exploded view the training apparatus of the present invention, including a floor anchor and striking ball according to a first embodiment of the present invention.
Figure 2:
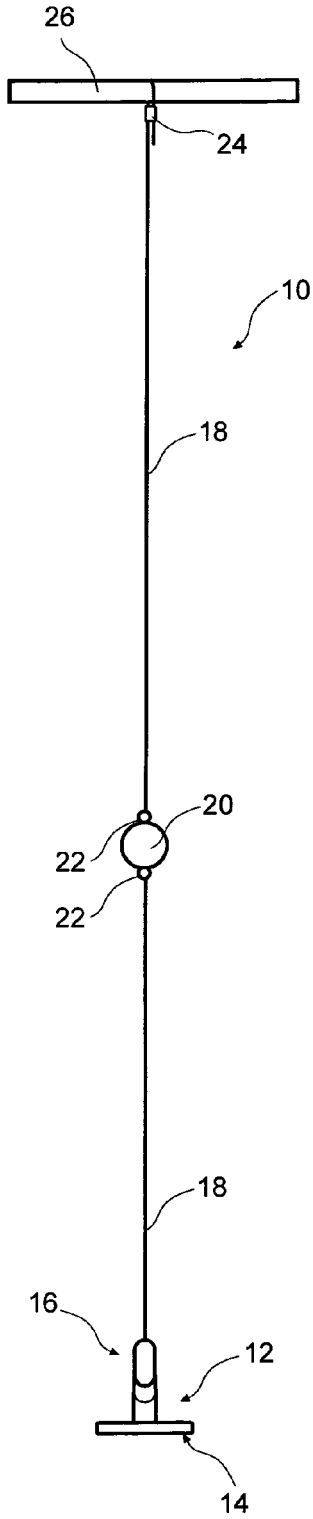
FIG. 2 illustrates in a front, fully assembled view the training apparatus of FIG. 1.
Figure 3B:
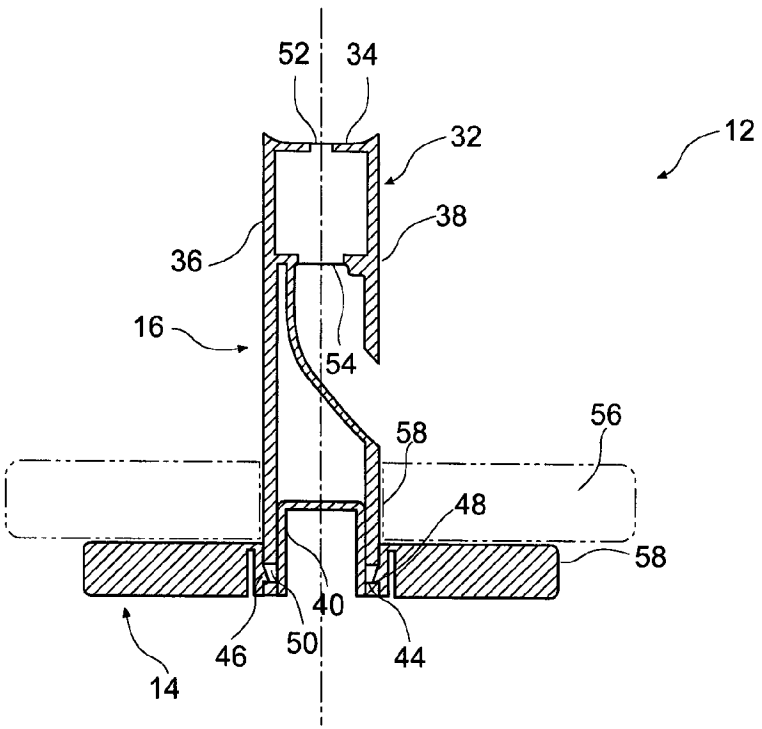
FIGS. 3*a*-3*b* illustrate progressively, in cross sectional view, how the upright portion of the floor anchor engages the base plate by way of a snap fit.
Figure 3A:
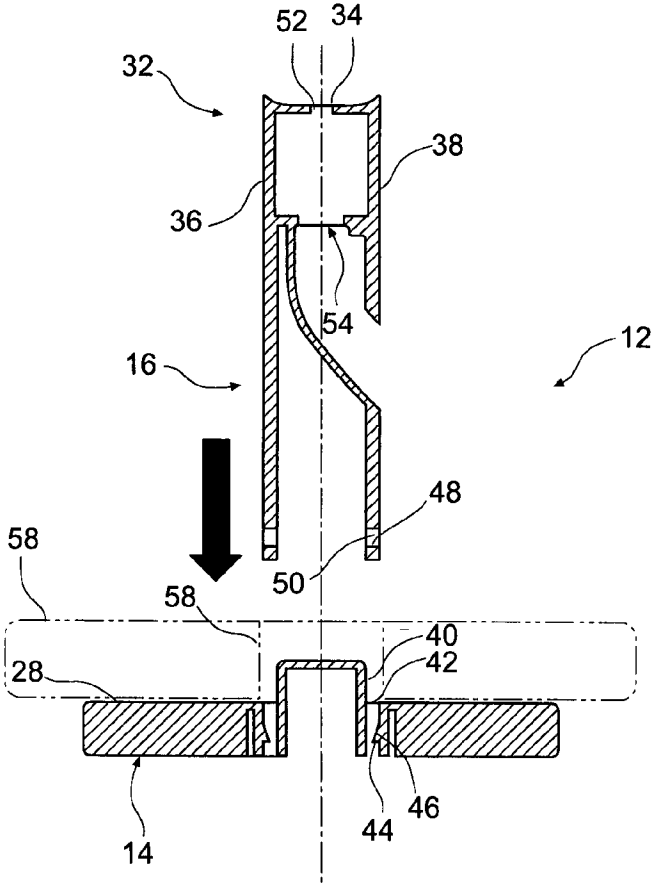
Figure 4B:
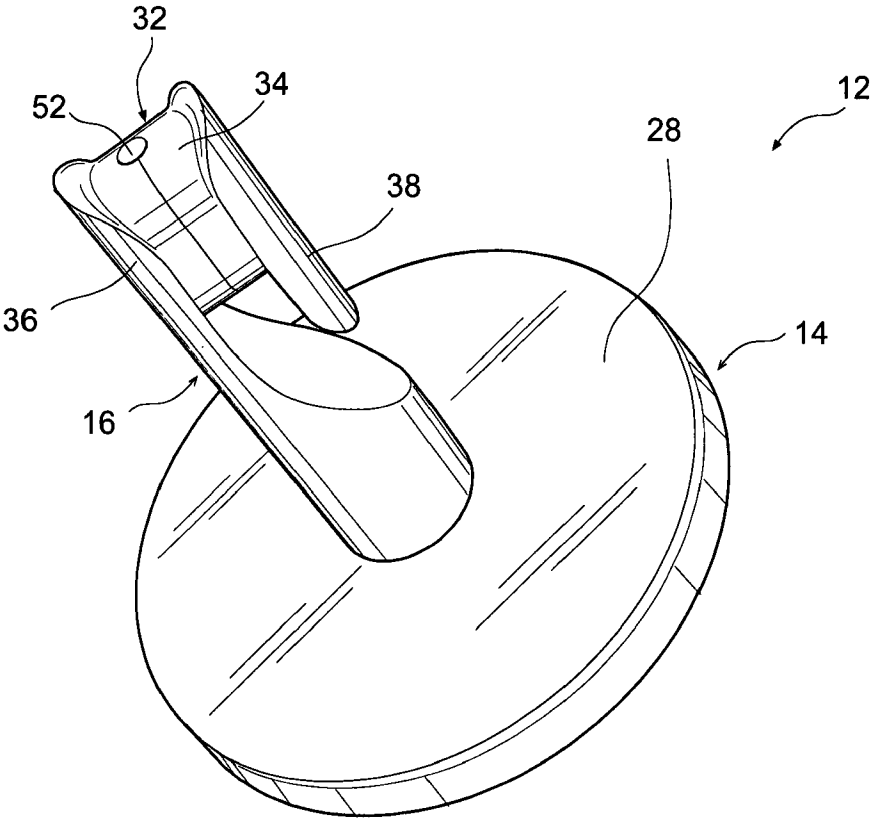
FIGS. 4*a*-4*b* illustrate a bottom and top perspective view respectively of the assembled floor anchor.
Figure 4A:
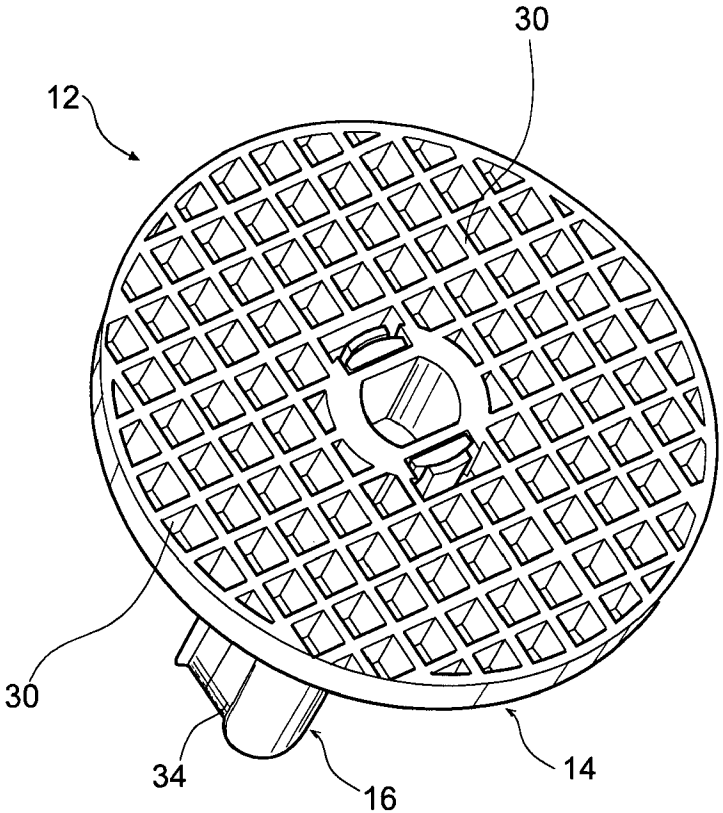

The training apparatus 10 is illustrated in FIG. 1 in a disassembled state and in FIG. 2 in a fully assembled state ready for use. The apparatus 10 comprises a floor anchor 12 which according to a first embodiment of the invention includes a base plate 14 and an upright portion 16 as described in more detail below, a cord 18, at least one lightweight striking ball 20, cord locks 22 for preventing the ball(s) from vertical movement along the cord 18, and an adjustment clip 24 which allows the height and initial tension of the cord 18 to be adjusted according to the height of a supporting structure 26 over which the cord is looped. The floor anchor 12 is shown in greater detail in FIGS. 3-5, and the remaining components are shown separately in FIGS. 6-8. As an indication of the size of the apparatus, the diameter of the floor anchor base plate 14 is approximately 15 centimeters.

The base plate 14 of the floor anchor 12 includes an upper circular surface 28 supported above by enclosed mesh framework 30 for increased strength and for minimising material usage during construction. The upright portion 16 is also substantially hollow, and includes a cylindrical lower end and a cord tension adjustment means 32 at its upper end which is also of the same cylindrical dimension. It is to be understood however that these structures could be any other suitable shape.

The tension adjustment means 32 is in the form of a horizontal spool 34 about which the cord 18 is adapted to be wound. The horizontal spool 34 is fixed between a wall 36 extending upwardly from the lower end of the upright portion 16, and a horizontally opposed end cap 38, both of which are of a greater dimension to that of the horizontal spool 34 so that any wound cord 18 is maintained therebetween.

The base plate 14 includes at its centre a raised projection 40 defined by an annular groove 42 which is shaped to receive the lower end of the upright portion 16. Accordingly, the lower end of the cylindrical upright portion 16 is adapted to be inserted into the groove 42 so that the raised projection 40 extends a short distance inside the hollow upright portion 16. The lower end of the upright portion 16 and the inside of the groove 42 are configured to enable a snap fit connection between the upright projection 16 and the base plate 14.

More particularly, snap fit connection is achieved by way of engagement between a downwardly facing horizontal surface 44 of an inward shoulder 46 located inside the annular groove 42, and an opposed horizontal surface 48 formed by an aperture 50 in the lower end of the upright portion 16. The shoulder 42 is configured to be able to flex outwardly slightly to allow for initial insertion of the upright portion, and those skilled in the art would realise that upon further insertion, the shoulder will eventually snap back to its original position thereby preventing the upright portion 14 from upward movement. The base plate 14 preferably includes an abutting surface (not shown) for preventing the upright portion 16 from being able to move further inside the groove 42 once it is snap fit in place. All components of the floor anchor 12 are preferably injection moulded from plastic material.

Once the two components have been locked together, they do not need to be separated again for the lifetime of the apparatus, although if need be, the connection could easily be made to have an unlocking mechanism.

Extending vertically through the upper side of the hollow horizontal spool 34 is an aperture 52, and through the lower side an aperture 54 of larger diameter. The aperture 52 is of a sufficient diameter to allow for insertion of the cord 18, but is not large enough to allow for one to pull a knotted end of the cord 18 out from inside the spool 34. The aperture 54 is sufficiently large to accommodate the knotted end (not shown). Thus, as those skilled in the art would appreciate, the end of the chord 18 is adapted to be inserted through aperture 52, tied into a knot, and then pulled back up through aperture 54 until it is housed inside the horizontal spool 34 where it can no longer pass through aperture 52. This is the means by which the cord 18 is secured to the anchor 12.

The floor anchor 12 requires weight to be secured to the floor. In preference a weighted disk 56 such as those commonly used in standard gym equipment is used. Such disks 56 include a central aperture 58 of an internationally standard diameter. The disk 56 is adapted to be placed over the upright portion 16 so that the upright portion 16 extends through the aperture 58. For this reason, the upright portion 16 including the tension adjustment means 32 needs to be of a maximum cross-sectional size, in this case diameter, that is less than the size of the disk aperture 58.

In the embodiment shown, the upright portion 16 is substantially cylindrical along its length and of a diameter slightly less than that of aperture 58 so that it may extend snugly there through. Therefore, when a weights disk 56 is placed over the upright portion 16 it may slide down and rest above the base plate surface 28. It has been found that at a minimum, a weight of approximately 2.5 kg should be used.

Figure 9A:
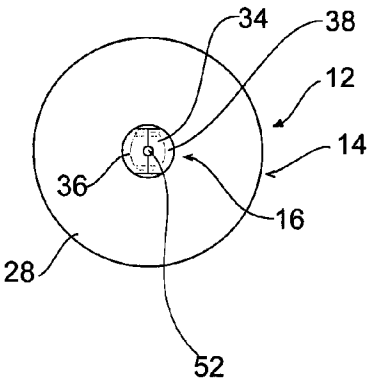
FIG. 9*a* illustrates a side and top view of the floor anchor of FIG. 5 having two 1.25 kg weight disks securing the anchor to the ground.
Figure 9A:
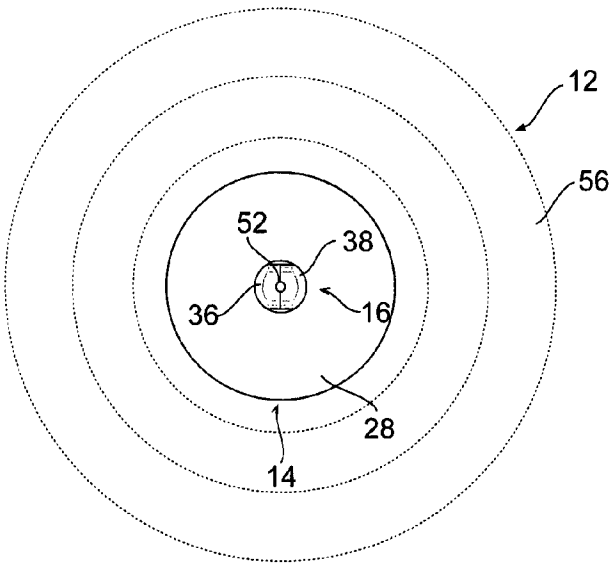
Figure 9A:
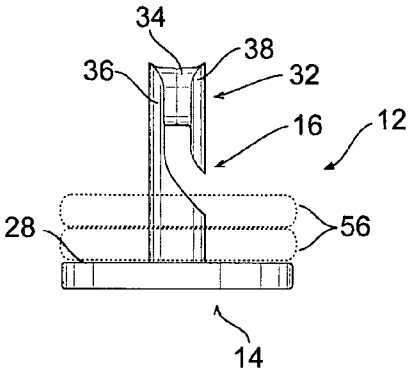
Figure 9B:
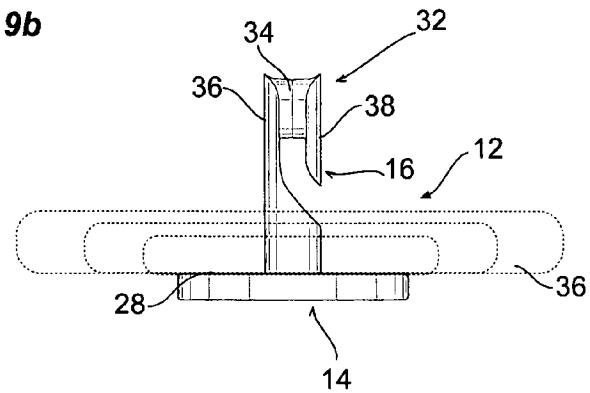
FIG. 9*b* illustrates a side and top view of the floor anchor of FIG. 5 showing how the floor anchor may accommodate larger weights disks.

The anchor 12 as shown in the drawings has been designed to be neatly secured by two 1.25 kg disks stacked one above the other with no overhang for visual appeal, as shown in FIG. 9*a*. It is to be understood however than only one disk of greater size and weight could be used, as shown in FIG. 9*b*. A benefit to using standard weights as described above is that it allows a person to use existing weights they may already possess or have access to.

The dimensions and physical characteristics of the striking ball 20 is also of importance to the working of the present invention. The ball 20 is preferably constructed of a soft rubber material, has a diameter of approximately 5.5 cm, and weighs approximately 40 grams. The ball 20 includes a straight channel 60 extending therethrough, adapted to receive a solid tube 62 with cord 18 adapted to extend through the tube 62. The cord locks 22 are used to lock the ball 20 at predetermined heights along the cord 18.

The cord locks 22 are well known in the art, being of the type which include an outer casing 64 and a push button 66, both of which include apertures through which the cord 18 extends. The button 66 is spring biased in a first position in which the apertures are not aligned, thereby locking the cord 18 therebetween. The button 66 is moveable to a second position in which the apertures become coaxially aligned to thereby unlock the cord 18. Therefore when the button 66 is manually pushed, the cord locks 22 can be moved to desired heights along the cord 18, and then released to thereby lock the cord 18 at the desired height.

The adjustment clip 24 of FIG. 8, which is of a substantially rectangular shape, includes an aperture 68 extending through one side thereof, through which the upper end of the cord 18 is adapted to be inserted, and an open zig-zag type channel 70 extending along the opposed side, which is used to accommodate and lock the cord after it has been looped around a supporting structure 26, in a manner which allows for quick and simple adjustment thereafter. This is important in situations where the apparatus is used in different environments, whereby the height of the supporting structure 26 could be changing all the time.

It is also helpful because one can adjust the initial tension of the cord by simply dislodging it from the channel 70 and pulling or releasing cord as required, before locking it again. The channel 70 also includes downwardly extending barbs 72 which serve as an additional locking means.

The steps for assembly of apparatus 10, according to a preferred method of doing so, are shown in FIGS. 10*a*-10*e*), and described as follows:

Step 1: Placing the floor anchor base plate 14 in a suitable location on the ground, and then placing a weights disk 56 above surface 28 of the base plate 14;

Step 2: Feeding a cord lock 22, followed by the ball 20, followed by a second cord lock 22 onto the cord 18;

Step 2: Inserting the lower end of the cord 18 through aperture 52 of the upright portion 16, tying the end into a knot, and then pulling the cord until the knot is secured inside the horizontal spool;

Step 3: Inserting the upright portion into the weights disk aperture 58 and into the annular groove 42 of the base plate 14 until it is snap fit in place, as described above;

Step 4: Inserting the upper end of the cord upwards through aperture 68 of the adjustment clip 24, over a supporting structure 26, pulling the cord until a suitable initial cord tension is reached with no lag, and then feeding the cord 18 through channel 70 thereby locking the cord 18;

Step 5: Squeezing the cord locks 22, then raising or lowering the ball 20 to the desired strike height, or just above the desired strike rate if further tensioning is envisioned; and Step 5: Tensioning the cord as desired by wrapping or looping the cord 18 about the horizontal spool 34 of the tension adjustment means 32.

FIG. 11 illustrates a user 74 punching the ball 20 once the apparatus 10 is assembled as outlined above. In Step 5 above, when adjusting the tension of the product, one needs to simply pull the cord 18 down with one hand to create some slack then wrap the cord 18 around the spool 34. Each rotation creates a new maximum distance the ball can travel as shown in FIG. 11. Those skilled in the art would appreciate that the greater the tension, the more short and sharp strikes are required. Depending on the height of the ball 20, there are approximately eight varied tensions. Each varied tension requires a user to stand at different distances and strike at varied speeds, allowing the user great flexibility and the ability to challenge themselves by randomly changing tensions.

It is to be understood that the tension adjustment means 32 is not intended to be limited to that which is illustrated and described. A manual winding mechanism (not shown) could equally well be used whereby the cord 18 is secured to a rotatable spool and simply wound by rotation of a crank or the like. However in the interest of maintaining the lightweight, portable and non-complex characteristics of the apparatus 10, it is preferable that no moving parts are involved in increasing and decreasing the tension.

In being able to select the different tensions as described above, many different styles of martial arts can be practiced. For example, looping the cord 18 around the spool 34 six times allows for close quarter attacking and defence training.

In order to show how useful the apparatus 10 of the present invention is across all areas of martial arts, some practice routines are now described which have not been possible using conventional training apparatus.

Figure 12B:
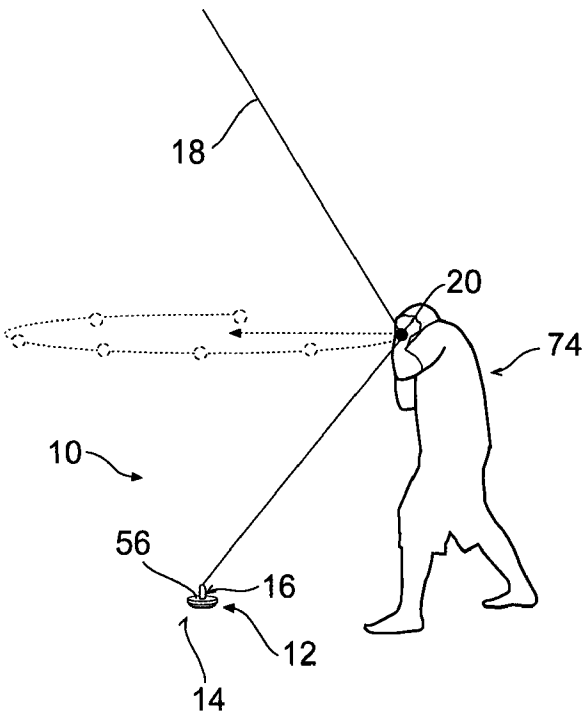
FIG. 12*b* illustrates a user defending himself against the returning ball following the hook-style punch of FIG. 11*a;*
Figure 12T:
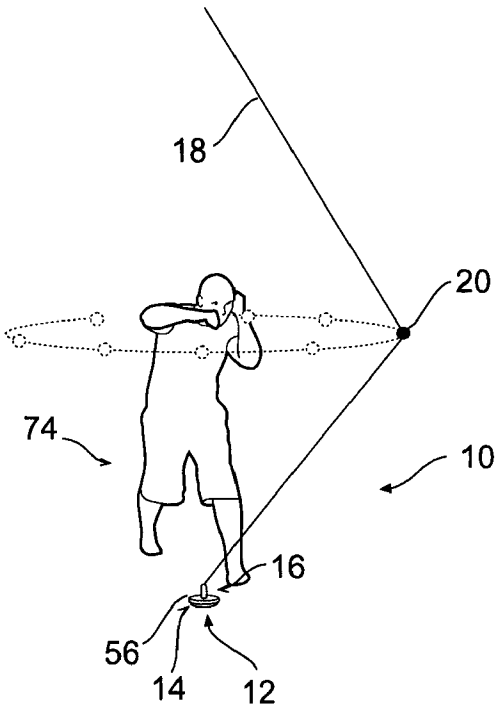
FIG. 12*a* illustrates the motion of the ball when struck by a hook-style punch which causes the ball to move in a circular motion.

Accuracy, speed and timing of hook style punches can be practiced when the ball 20 is struck in a circular motion, whilst also allowing for defensive responses when the ball 20 returns to the user following a punch. This is shown in FIGS. 12*a*-12*b*. The user 74 also has the ability to change the motion of the ball 20 from a circular motion to a straight motion randomly throughout the workout. For example, a user may strike the ball in a circulatory motion with a hook punch, then defend the rebound causing the ball to move forwards in a straight line. This then allows the user to strike the ball in a circulatory motion again using another hook shot. The apparatus of the present invention allows a user to practice a wide range of offensive and defensive exercises with minimal resistance from the ball.

Because the ball 20 is so lightweight, unlike a real punch or a larger/heavier ball, it will not throw the user off balance or injure the user. The apparatus therefore allows a user to focus on the accuracy and timing of the chosen defence. If the user is ineffective in their defence, they will receive a much more subtle reminder.

Figure 13C:
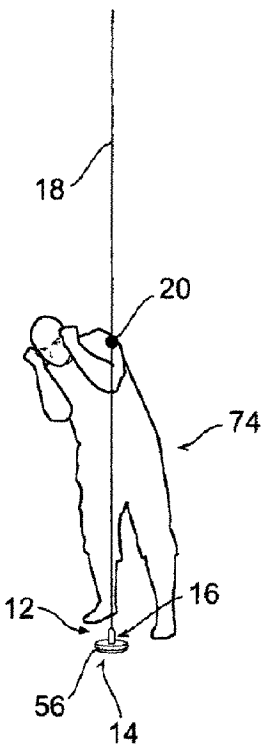
FIG. 13*c* illustrates an alternate view of FIG. 12*b;*
Figure 13B:
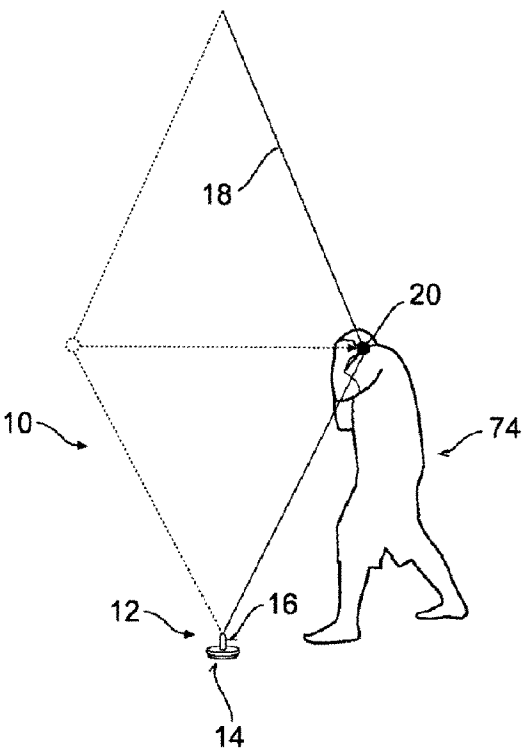
FIG. 13*b* illustrates a user defending himself against the returning ball after releasing it as shown in FIG. 12*a;*
Figure 13A:
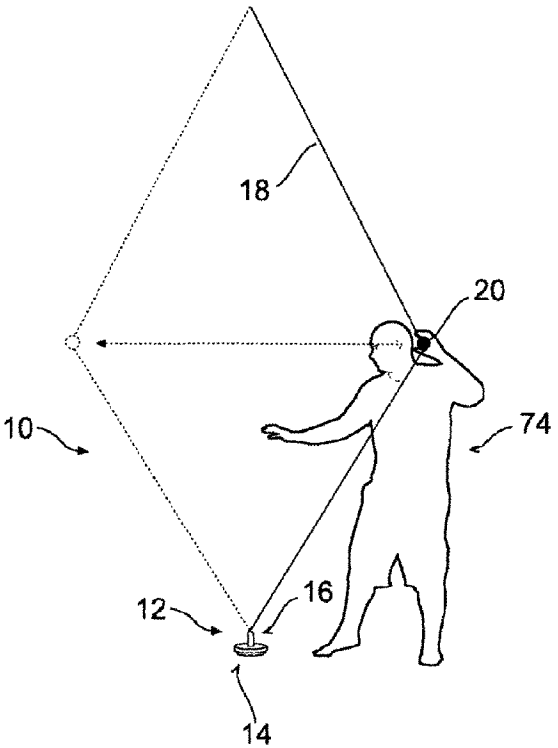
FIG. 13*a* illustrates a user pulling the ball back toward himself, and shown in dotted lines is the ball in a position after the ball has been released.

As well as being lightweight, the ball 20 is of a size and volume to simulate a human fist. If the user pulls the ball back toward themselves until it is at maximum tension, then release the ball so it rebounds back, a further simulation of a real punch is created. This allows them to practice their chosen defence with more control as shown in FIGS. 13*a*-13*c*. One a predetermined skill level is achieved using this method, the user can begin continuous combinations such as strike, strike, block, strike, strike, block, for example. Continuous defensive and offensive skills can therefore be practiced at the same time which is not possible in hitherto known apparatus of this kind.

Figure 14B:
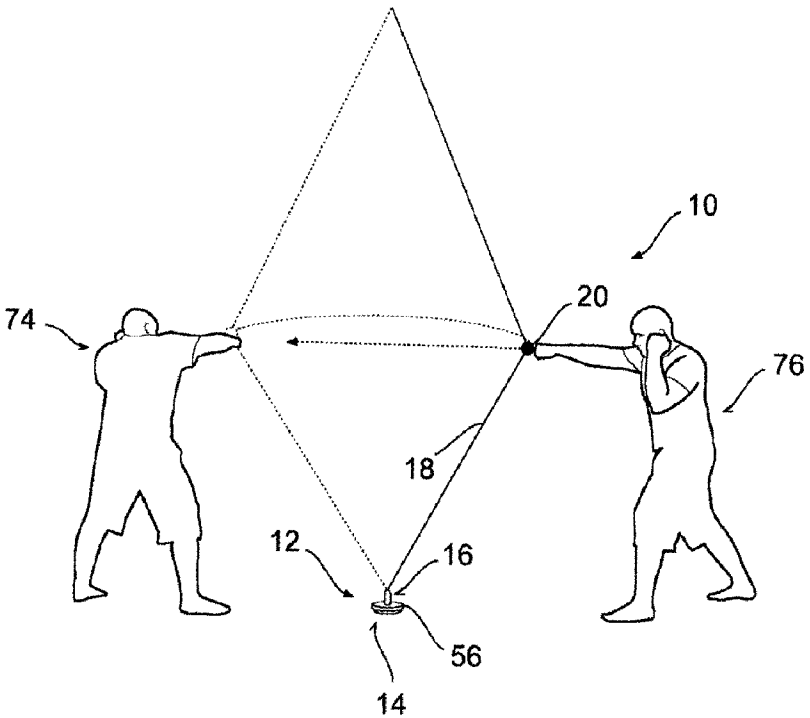
FIG. 14*b* illustrates a first user striking the ball in a circular motion from one side, and a second user returning the strike using a jab-style punch from the opposite side.
Figure 14A:
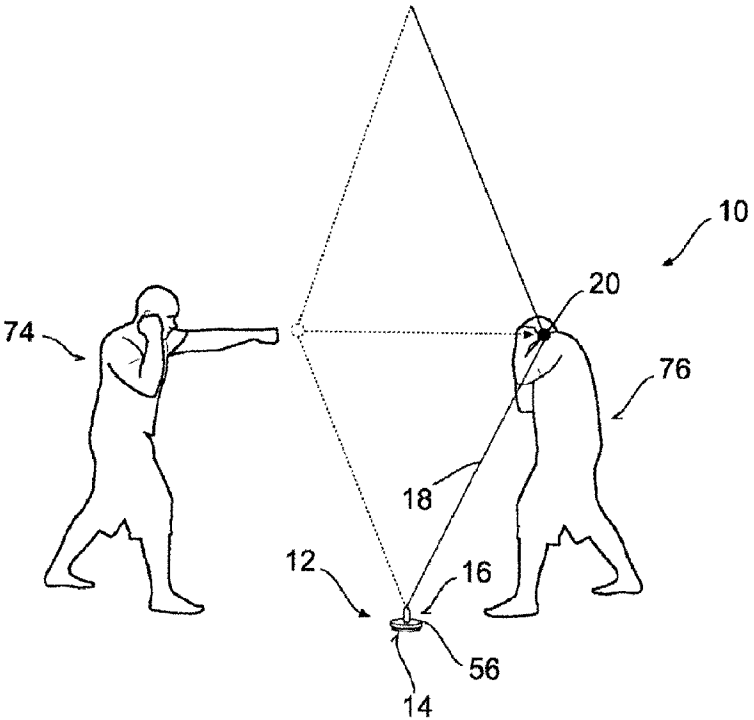
FIG. 14*a* illustrates a first user striking the ball using a jab-style punch and a second user dodging the ball on the opposite side.

It is to be understood that the apparatus 10 is not limited to use by one user. Because of the distance the ball travels when struck, two people are able to use the product simultaneously without clashing hands or smothering the ball, as shown in FIGS. 14*a*-14*b*. Users can further be challenged by the unpredictability caused by the opposed person's strike. The unpredictable motion of a return strike could be counteracted by a defensive move or a counter attack and, as with traditional sparring, the partners will be able to communicate with one another the desired intensity of the workout. The maximum circumference achievable, that is, when the cord 18 is looped around only once, can be up to 6 meters so a first user 74 and a second user 76 may stand a significant distance apart when using the apparatus simultaneously.

Figure 15C:
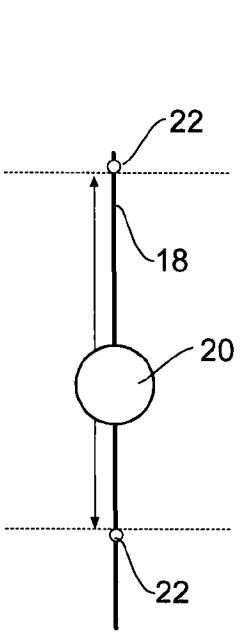
FIG. 15*c* illustrates an enlarged front view of the spaced apart cord locks and movement of the striking ball therebetween.
Figure 15B:
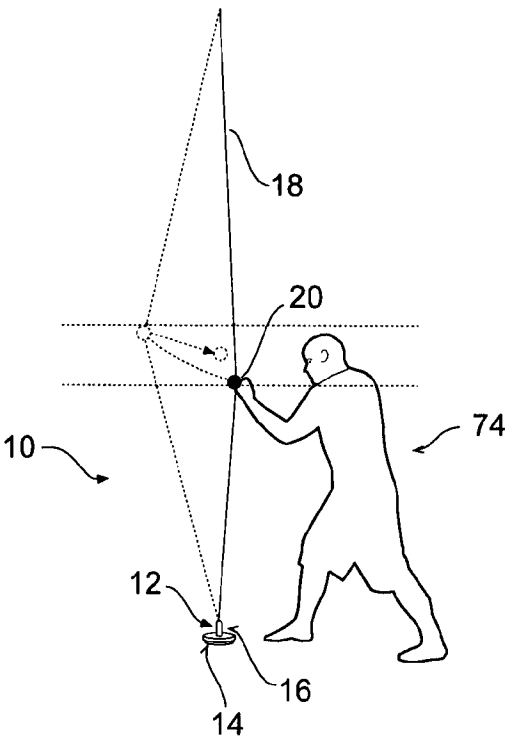
FIG. 15*b* illustrates a user striking the ball using an uppercut-style punch whereby the cord locks are spaced apart to define a vertical zone within which the ball is free to move.
Figure 15A:
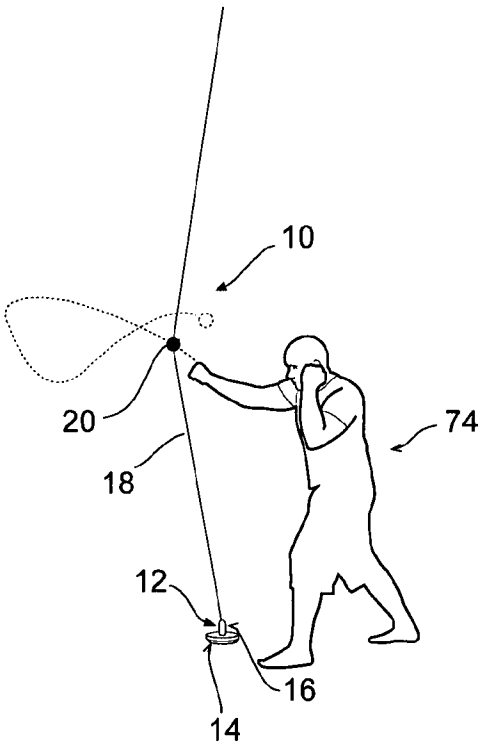
FIG. 15*a* illustrates a user striking the ball using an uppercut-style punch whereby the cord locks are positioned to secure the ball at one height.

An important feature of the present invention is in the ball's ability to travel in vertical and horizontal movements simultaneously. This can be achieved in a number of ways. For example, if a user 74 strikes the ball 20 with an upper cut or other punch involving a vertical component, as shown in FIG. 15*a*, the ball 20 will significantly bounce vertically and this will vary depending on the level of tension. Alternatively, the cord locks 22 could be separated as shown in FIGS. 15*b*-15*c* to define a zone wherein the ball 20 is allowed free vertical movement corresponding with a particular target zone, for example, the rib cage of an opponent. Such a zone could be made anywhere along the cord 18.

Random vertical and horizontal movements such as those described above also alter the angle and height in which the ball returns to the user 12 following a strike. The user 12 may therefore also practice defensive movements at varied heights.

The target ball is relatively bouncy so if a user 12 strikes it off-centre, for example on the knuckle or the thumb, the ball 20 may run off in an undesired path. Therefore the precision of a user's technique could be tested by leaving the top cord lock 22 off completely, and attempting to maintain the ball 20 on the lower cord lock without it lifting.

On conventional training apparatus, the diameter of the ball is approximately 25 cm. As mentioned, the diameter of the ball of the present invention is approximately 5.5 cm which effectively means that a user needs to be five times more accurate in their striking of the ball. Therefore, the size of the target requires greater accuracy and the fact that it is constructed of rubber and weighs only 40 grams approximately, means that minimal force is required when struck, yet it still provides a dynamic rebound.

Figure 16B:
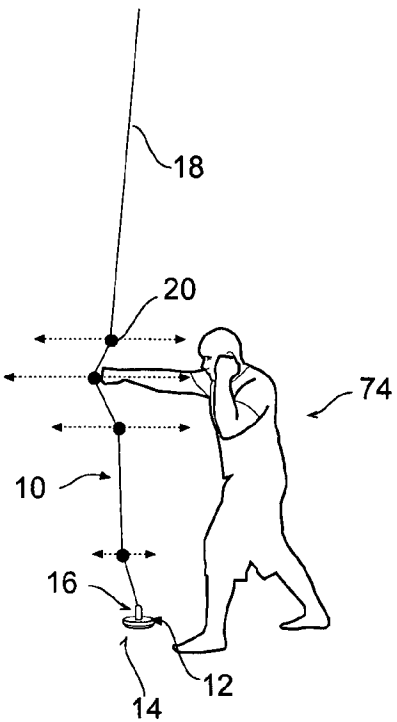
FIG. 16*b* illustrates a training apparatus including a plurality of balls secured at different heights along the cord.
Figure 16A:
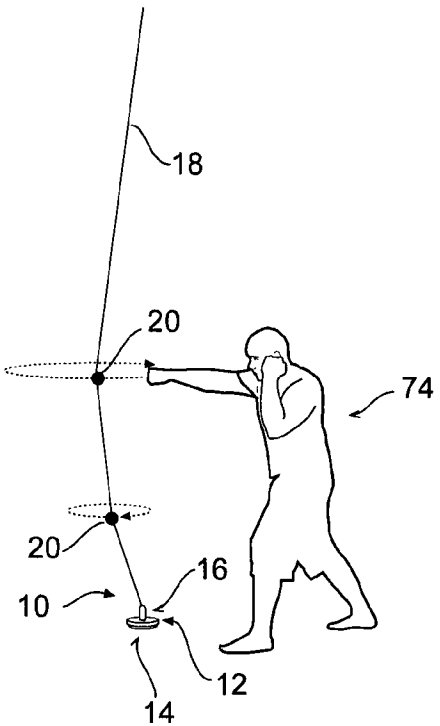
FIG. 16*a* illustrates a training apparatus including a first ball at chin height and a second ball at knee height.

The invention should not be limited to use of only one ball 20 either. Multiple balls could be locked to the cord 18 thereby providing multiple targets, target zones, or combinations thereof. In adding further balls 20 to the cord 18, one may also add to the unpredictability of the rebound motion. For example, having a ball at the users chin height followed by another at knee height, as shown in FIG. 16*a*, causes the motion of the higher ball to be altered by the weighted movement of the lower ball. FIG. 16*b* illustrates the training apparatus 10 having a plurality of balls attached.

The dynamics of the balls 20, combined with their weight and the elasticity of the cord 18 provide a unique striking challenge that is more unpredictable than using a single ball. Where there are multiple balls added along the cord, shorter, more sudden and random movements are required.

One of the most advantageous features of the apparatus 10 of the present invention is its portability. Because the floor anchor 16 and cord 18 need no floor or ceiling mounting components, a user is able to place the product virtually anywhere by simply tying the cord 18 to any overhead object 26 that is stable. The versatility of the apparatus 10 allows the apparatus to be used in virtually any environment with the ability to be set up and dismantled in seconds.

Figure 17:
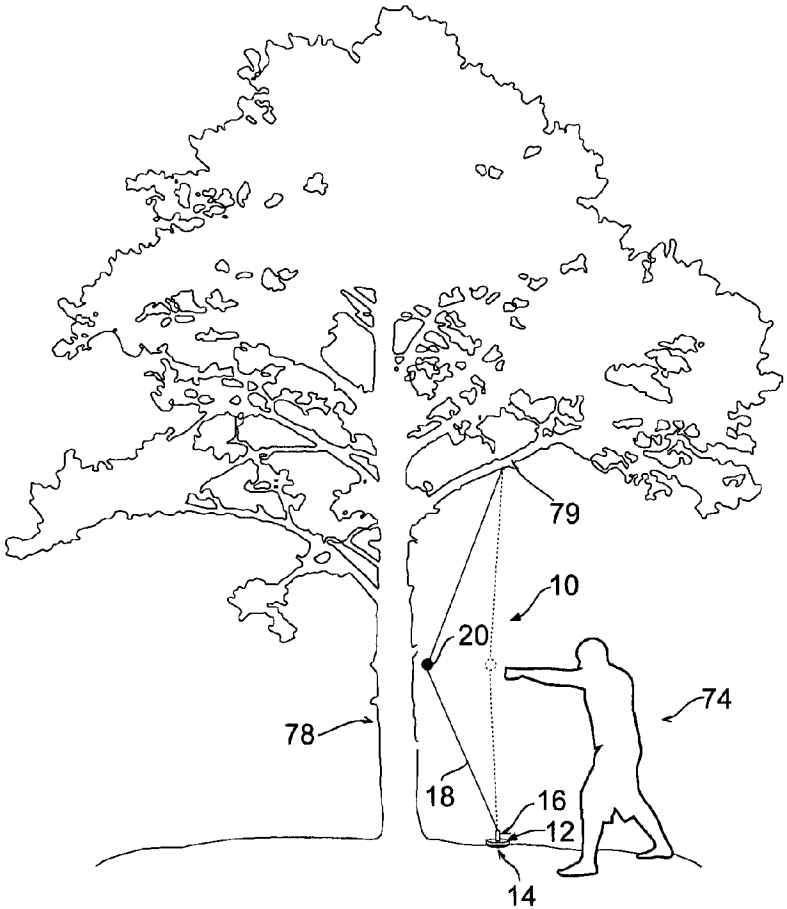
FIG. 17 illustrates a training apparatus used outdoors and attached at its upper end to a tree branch.

For example, FIG. 17 illustrates the apparatus 10 being used beneath a tree 78 with the cord 18 being tied to a tree branch 79. The apparatus 10 has been set up in this situation so that the ball 20 strikes the tree 54 to provide an unpredictable rebound. In being able to use objects in a chosen environment adds enjoyment to training, as well as providing for skill development in intermediate to advanced users.

Figure 18B:
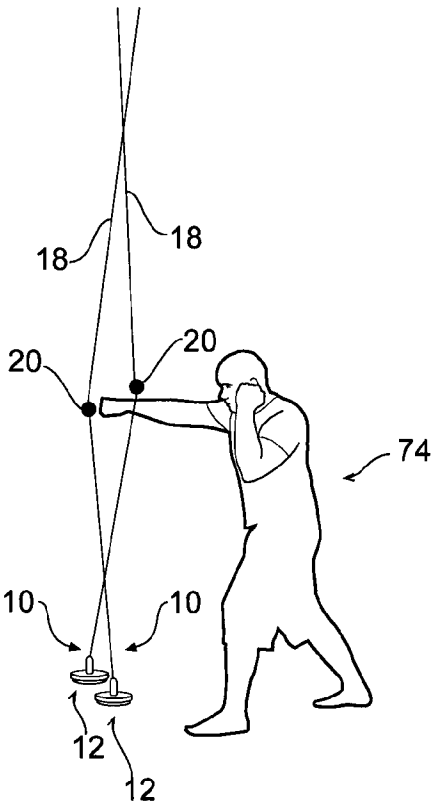
FIG. 18*b* illustrates a user training on two apparatus' of the present invention.
Figure 18A:
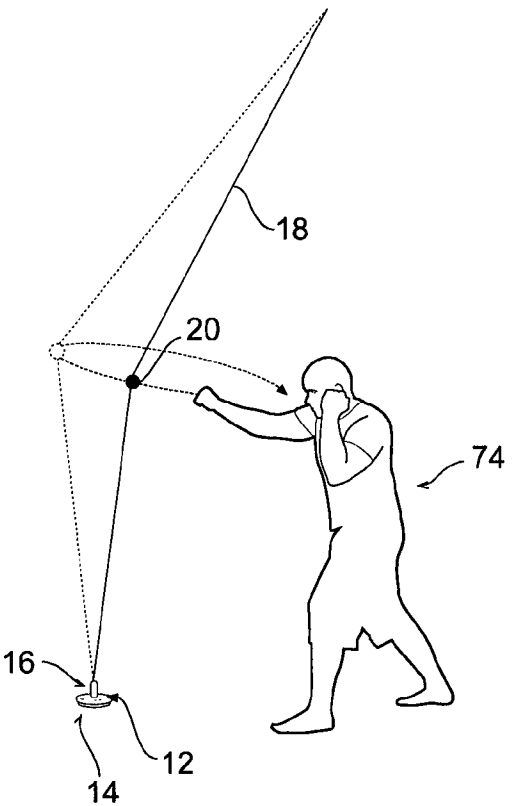
FIG. 18*a* illustrates a user striking the ball when the floor anchor is spaced away from the vertical axis of the upper mounting point so that the cord extends at an angle relative to the floor.

The ease at which the anchor may be transported provides a further means of variability in a user's workout. The floor anchor 16 need not necessarily be placed directly beneath, or in the same vertical axis as the point to which it is tied to the structural support 26, but some distance away. FIG. 18*a* shows such a configuration, where the cord 18 extends to the ground on an angle rather than vertically. This provides for an even further level of unpredictability.

Further still, it is to be understood that a user need not limit themselves to use of only one apparatus 10. FIG. 18*b* illustrates two apparatus 10 used side by side. Users may also wish to line up a plurality of training apparatus 10 in a row, to practice leg and arm striking drills for example. In a training environment, multiple users may take turns one after the other to strike the targets, or alternatively, wait until each person has finished. As the user(s) gets the feel for the exercise, they may attempt varied strikes on each apparatus, for example, low kick on apparatus A, high kick on apparatus B, straight punch on apparatus C, and so on. Although not shown, the floor anchors 12 of multiple apparatus 10 could even be manufactured integrally as a single unit, and their spaced apart distances made adjustable.

Figure 19B:
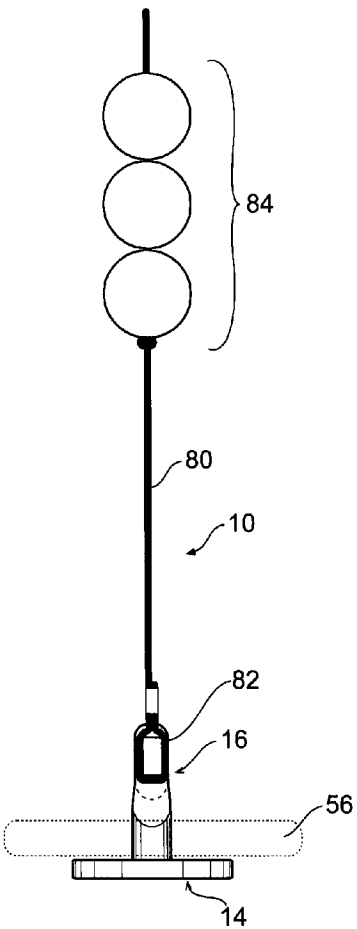
FIG. 19*b* illustrates a side view of the apparatus of FIG. 20*a*.
Figure 19A:
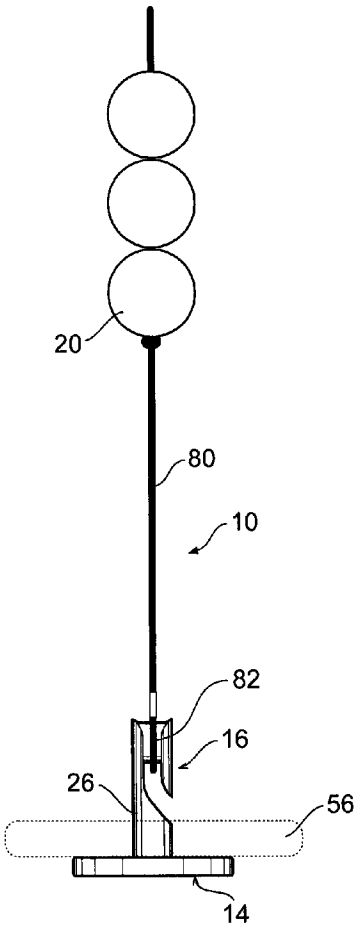
FIG. 19*a* illustrates a front view of an apparatus according to a further aspect of the invention.
Figure 20C:
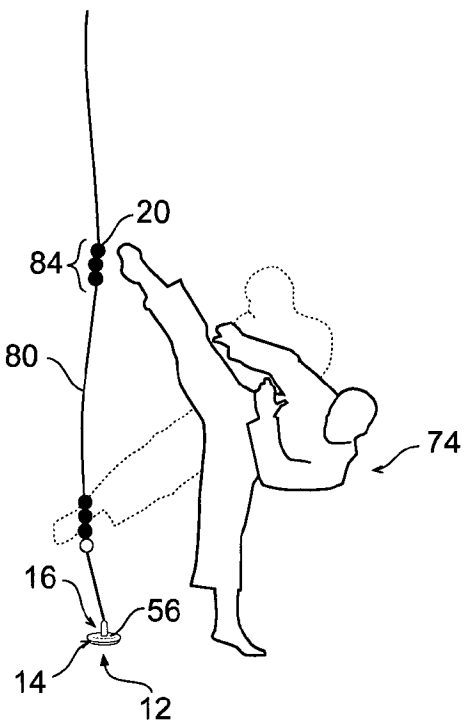
FIGS. 20*a*-20*c* illustrate a user performing various different strikes on spaced apart and grouped targets.
Figure 20B:
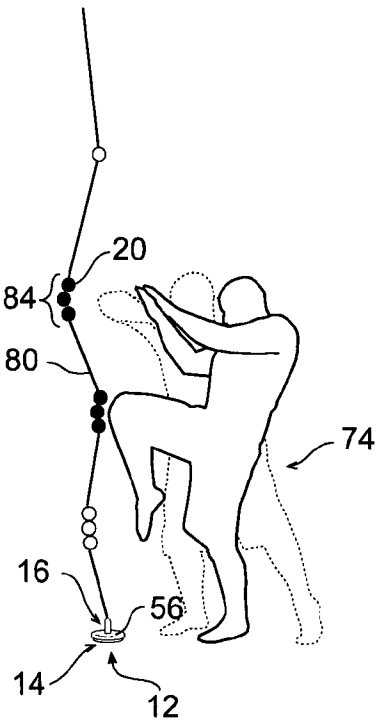
Figure 20A:
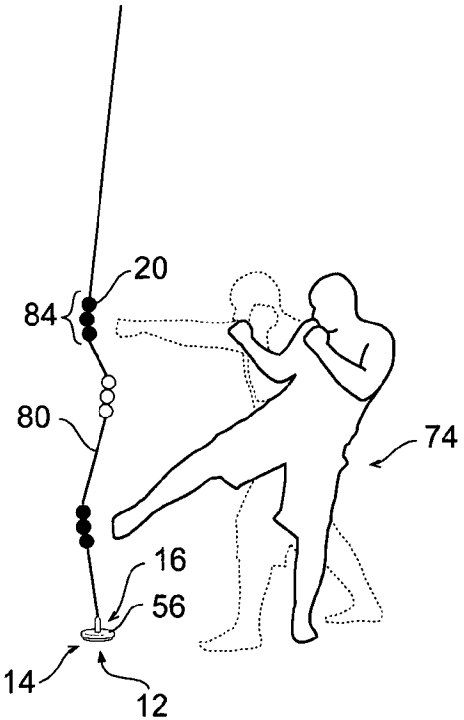

A further variation of the present invention is illustrated in FIGS. 19*a*-19*b* wherein the apparatus 10 includes a thicker cord 80 having a looped end 82 adapted to be secured to the spool 34. The thicker cord 80 can be used to support the weight of numerous balls, and larger balls, providing a great rebound effect. Upon the user kicking or punching a group 84 of multiple balls on the thicker cord, as shown in FIGS. 20*a*-20*c*, the power of the strike becomes absorbed and the balls move a shorter distance, and more slowly.

Such a configuration allows the user to strike the apparatus multiple times in a short period of time. Although the targets move within a smaller space, because there are so many targets available, the intensity and randomness of the exercise is what provides the challenge. The groups of multiple balls may be colour coded to indicate different zones, for example, the apparatus could include four yellow balls at waist height and three differently coloured balls at head height.

Figure 22:
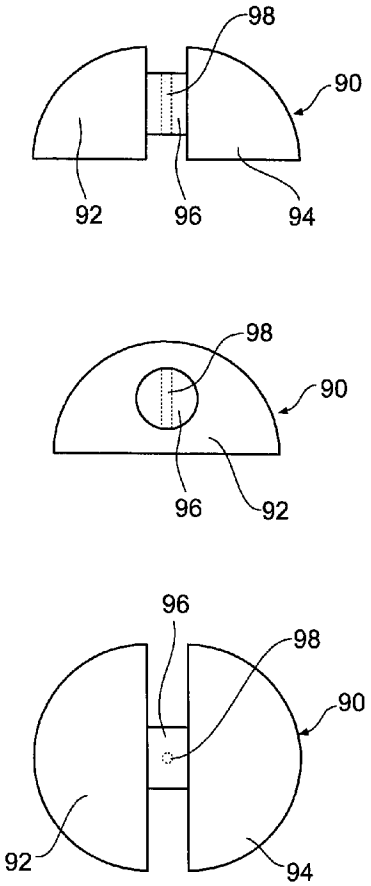
FIG. 22 illustrates a front, side and top view of the floor anchor forming part of the apparatus of FIG. 21.
Figure 21:
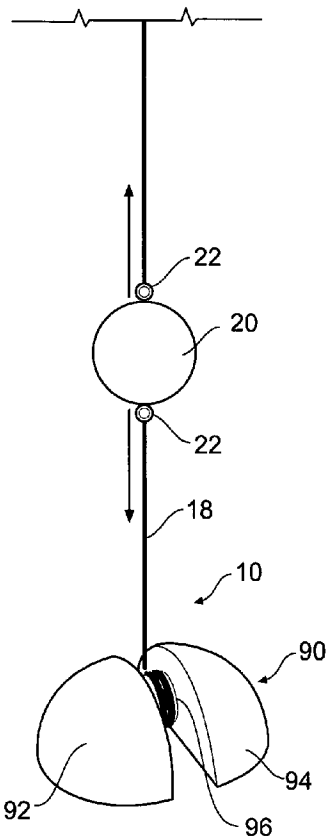
FIG. 21 illustrates a perspective view of a training apparatus including a floor anchor according to a second embodiment of the present invention.
Figure 23D:
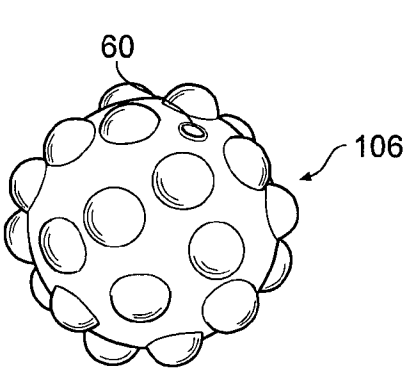
FIGS. 23*a*-23*d* illustrate perspective views of different striking balls according to a further embodiment of the invention.
Figure 23C:
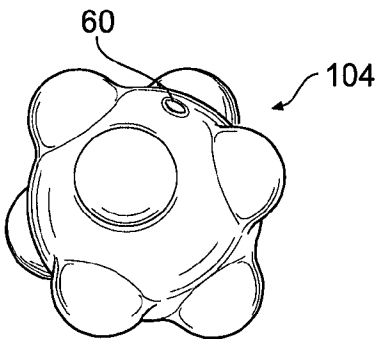
Figure 23B:
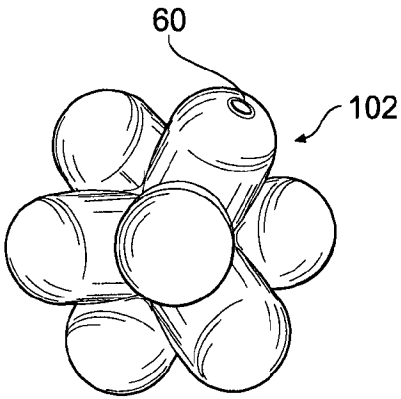
Figure 23A:
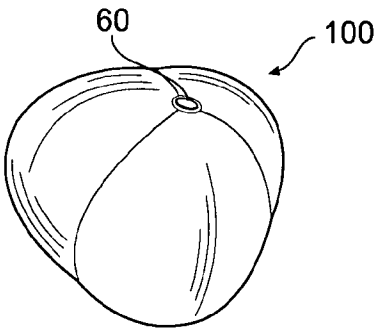

FIG. 21 illustrates the apparatus 10 of the invention including a floor anchor 90 according to a second embodiment of the present invention. FIG. 22 illustrates this floor anchor 90 in different views. The floor anchor 90 is weighted and dome shaped, having two spaced apart halves 92 and 94 which are separated by a horizontal component or spool 96. The horizontal spool 96 includes an aperture 98 through which the cord 18 is adapted to extend and be secured by way of a knot.

Therefore, rather than wrapping the cord 18 around the spool, in use, the anchor 90 may simply be lifted and spun about a horizontal axis to thereby increase or decrease tension, as desired. In preference, the anchor weighs approximately 2.5 kg to secure the apparatus to the floor. Apart from the different tensions adjustment means, the working of this apparatus is the same as that described above.

Finally, the striking object need not be limited to a spherical shaped ball. The target could be shaped in any manner and, in fact, it is preferable that the target be shaped to increase the unpredictability of the apparatus even further. For example, illustrated in FIGS. 23*a*-23*d* are four further ball variations 100, 102, 104 and 106. Those skilled in the art would appreciate that the various differently shaped protrusions of the balls will cause each one to move in a different manner when struck.

The apparatus embodied in the present invention therefore provides a unique striking and defensive accuracy training tool that can challenge any form of martial arts or fighting style at any level to improve speed, timing and accuracy with minimal resistance. Its full adjustability and versatility allows users to adapt the apparatus to their specific needs and training styles. Its portability means the apparatus can used in any environment. Because there are no moving parts on the tension adjustment there will be virtually no wear for the lifetime of the product.

Further advantages and improvements may very well be made to the present invention without deviating from its scope. Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus.

In any claims that follow and in the summary of the invention, except where the context requires otherwise due to express language or necessary implication, the word "comprising" is used in the sense of "including", i.e. the features specified may be associated with further features in various embodiments of the invention.

The invention claimed is:

1. A portable exercise training apparatus characterised by:

a base adapted to be placed at an exercise location having an overhead structure, said base adapted to lie flat on a ground surface and be secured at said exercise location by its own weight;

a cord tie down member being removably engageable with said base such that when the tie down member and base are engaged the member forms an upright extension of said base at a central location thereof, said cord tie down member including a spool;

a resilient cord including a first end adapted to be secured to said cord tie down member, and a second end adapted to be secured to said overhead structure so that the cord extends between said base and said overhead structure at an initial tension, and whereby each winding of the cord about said spool represents tensioning of the cord by one increment;

at least one strike object associated with said cord, wherein the position of said strike object along the cord is adjustable to thereby facilitate positioning of said strike object to a desired height after the cord is secured.

2. A portable exercise training apparatus as characterised in claim 1 wherein the position of said strike object along the cord is adjustable to thereby facilitate positioning of said strike object to a desired height after a subsequent tension is set using said cord tensioning means.

3. A portable exercise training apparatus as characterised in claim 1 wherein said base further includes a means of supporting one or more weighted objects to assist in preventing the base from moving.

4. A portable exercise training apparatus as characterised in claim 3 wherein said one or more weighted objects includes two 1.25 kilogram weighted discs.

5. A portable exercise training apparatus as characterised in claim 1 wherein said spool is housed substantially inside said upright cord tie down member.

6. A portable exercise training apparatus as characterised in claim 1 wherein said spool is in the form of a horizontal extending spool.

7. A portable exercise training apparatus as characterised in claim 1 wherein said cord is of a resilience to allow for winding of said cord approximately eight times about the spool, representing eight different increments of tension.

8. A portable exercise training apparatus as characterised in claim 1 wherein said base and said cord tie down apparatus are adapted to engage by way of a snap fit connection.

9. A portable exercise training apparatus as characterised in claim 1 wherein said strike object is lockable along the cord using cord locks which include locking members that are moveable between a first position in which said cord is engaged by the lock, and a second position in which said cord is disengaged, said locking member being biased in said first position.

10. A portable exercise training apparatus as characterised in claim 1 wherein two cord locks are spaced apart on said cord to enable free vertical movement of said strike object between the spaced apart cord locks.

11. A portable exercise training apparatus as characterised in claim 1 wherein said apparatus includes a plurality of strike objects along said cord so that when one of said strike objects is struck, the remaining strike objects cause the struck object to move in an unpredictable manner.

12. A portable exercise training apparatus as characterised in claim 1 wherein said apparatus includes at least one group of two or more adjacent strike objects positioned along the cord.

13. A portable exercise training apparatus as characterised in claim 1 wherein said strike object is in the form of a non-inflatable, soft, rubber ball.

14. A portable exercise training apparatus as characterised in claim 13 wherein said ball is spherical in shape and approximately 5.5 centimeters in diameter.

15. A portable exercise training apparatus as characterised in claim 1 wherein said apparatus includes a plurality of differently shaped strike objects, including balls having outwardly extending protrusions, to ensure further unpredictability.

16. A portable exercise training apparatus characterised by:

a base adapted to be placed at an exercise location having an overhead structure, said base adapted to be secured at said exercise location by its own weight;

a resilient cord including a first end adapted to be secured to said base, and a second end adapted to be secured to said overhead structure so that the cord extends between said base and said overhead structure at an initial tension;

at least one strike object associated with said cord, wherein the position of said strike object along the cord is adjustable to thereby facilitate positioning of said strike object to a desired height after the cord is secured;

said cord tensioning means is in the form of a spool associated with said base, whereby each winding of the cord about said spool represents tensioning of the cord by one increment;

said base includes a base plate adapted to lie flat on a ground surface at said exercise location, and an upright portion positioned at the center of the base plate; and said base plate and said upright portion are separate members adapted to engage by way of a snap fit connection.

17. A portable exercise training apparatus as characterised in claim 1 wherein said base and said cord tie member are adapted to engage by way of a threaded connection.

18. A method of assembling a portable exercise training apparatus as defined in any one of claims 1-15, 16 and 17, said method characterised by the steps of:

positioning said weighted base on the ground surface;

connecting the cord tie down member to the base;

securing the first end of a resilient cord to the tie down member;

securing the second end of the resilient cord to the overhead structure, thereby creating an initial tension in the cord;

increasing the tension in the cord by winding the cord about the spool at least once; and positioning one or more strike objects along said cord so that they are disposed at desired striking heights.

* * * * *